US005729876A

United States Patent [19]

Johnson

[11] Patent Number: 5,729,876

[45] Date of Patent: Mar. 24, 1998

[54] FASTENER ASSEMBLY

[75] Inventor: James R. Johnson, Chamblee, Ga.

[73] Assignee: AMI/Recpro, Inc., Atlanta, Ga.

[21] Appl. No.: 580,809

[22] Filed: Dec. 29, 1995

Related U.S. Application Data

[63] Continuation-in-part of Ser. No. 436,573, May 8, 1995.

[51] Int. Cl.[6] ..... B65D 33/00

[52] U.S. Cl. ..... 24/587; 24/400; 383/63

[58] Field of Search ..... 24/587, 576, 399, 24/400; 383/63, 65, 5

[56] References Cited

U.S. PATENT DOCUMENTS

| | | | |
|---|---|---|---|
| Re. 28,969 | 9/1976 | Naito | 150/3 |
| 2,144,755 | 1/1939 | Freedman | 24/587 |
| 3,202,559 | 8/1965 | Laguerre | 156/66 |
| 3,323,707 | 6/1967 | King | 229/66 |
| 3,416,199 | 12/1968 | Imamura | 150/3 |
| 3,554,822 | 1/1971 | Schwarnhopf et al. | 196/66 |
| 3,565,147 | 2/1971 | Ausnit | 150/3 |
| 4,212,337 | 7/1980 | Kamp | 150/3 |
| 4,337,889 | 7/1982 | Moertel | 229/62 |
| 4,363,345 | 12/1982 | Scheibner | 150/3 |
| 4,498,939 | 2/1985 | Johnson | 156/66 |
| 4,561,108 | 12/1985 | Kamp | 383/63 |
| 4,617,683 | 10/1986 | Christoff | 383/63 |
| 4,655,862 | 4/1987 | Christoff et al. | 156/66 |
| 4,673,383 | 6/1987 | Bentsen | 493/381 |
| 4,709,399 | 11/1987 | Sanders | 383/66 |
| 4,710,968 | 12/1987 | Borchardt et al. | 383/63 |
| 4,736,496 | 4/1988 | Fisher et al. | 24/587 |
| 4,812,056 | 3/1989 | Zieke | 383/65 |
| 4,829,641 | 5/1989 | Williams | 24/587 |
| 4,964,739 | 10/1990 | Branson et al. | 383/5 |
| 5,012,561 | 5/1991 | Porchia et al. | 24/576 |
| 5,157,811 | 10/1992 | Bodolay | 24/30.5 |
| 5,368,394 | 11/1994 | Scott et al. | 383/63 |
| 5,403,094 | 4/1995 | Tomic | 24/587 |
| 5,462,360 | 10/1995 | Tilman et al. | 24/587 |
| 5,509,734 | 4/1996 | Ausnit | 24/587 |

*Primary Examiner*—Victor N. Sakran
*Attorney, Agent, or Firm*—Michael Best & Friedrich

[57] ABSTRACT

An improved reclosable fastener assembly is disclosed having a substantially C-shaped closure element which defines a channel, and a first arm and second arm extending from the ends thereof. Clasps are disposed on the ends of the arm portions which extend inwardly. A U-shaped closure element is further provided which has a curved centrally disposed portion and a pair of legs extending angularly outward from the center of the interior surface from the center line. The legs each have a hook on their end which extend laterally outward. A pair of bumpers are disposed on the base of the U-shaped member with a curved exterior portion between the end of the hook and the bumper on each side. The closure elements are constructed and arranged for reclosably fastening to each other over a predetermined length. One or more ribs are centrally disposed on the C-shape closure element which abut against the first and second legs and the curved portion during interlocking. In addition, the ribs further serve to align and maintain the positioning of the closure elements during sealing of the fastener assembly to one or more webs of plastic films in the manufacture of reclosable plastic bags.

33 Claims, 4 Drawing Sheets

FASTENER ASSEMBLY

The present invention is a continuation-in-part of U.S. patent application having Ser. No. 08/436,573, Filed May 8, 1995, entitled "IMPROVED FASTENER ASSEMBLY".

The present invention relates generally to reclosable plastic bags having fastener assemblies sealed thereon and more particularly to an improved fastener assembly which is self aligning, provides an improved differential opening force, and is elastically deformable and resilient fastener assemblies with improved sealing capabilities to reclosable plastic bags.

Reclosable bags typically are constructed of polyethylene. It is commonly known in the art to manufacture reclosable plastic bags having fastener assemblies sealed to opposing walls. U.S. Pat. No. 3,416,199 shows an example of reclosable bags formed of two opposed walls equipped at their mouth with fastener profiles. These profiles include a male profile attached to one wall and a female profile attached to the other wall. The profiles are shaped so that, when they are aligned and pressed together into an engaging relationship, they form a continuous closure for the bag. The bag may be opened by pulling the walls apart, thereby separating the profiles. A variety of profiles are shown in U.S. Pat. Nos. 28,969; 3,323,707; 4,212,337; 4,363,345; 4,561,108; and 4,812,056. In addition, U.S. Pat. Nos. 4,736,496 and 5,012,561 disclose reclosable bags with profiles with profiles and internal ribs adjacent to the profiles. U.S. Pat. No. 3,565,147 discloses a rib and bar arrangement for fastener profiles. U.S. Pat. No. 5,368,394 discloses a fastener profile assembly having stabilizer wedges on the lateral flanges of both the male and female fasteners. The stabilizer wedges on the male assembly are sized and positioned to abut internally to the stabilizer wedges on the female fastener profile, but do not cushion.

Many of the aforesaid fastener assemblies include differential opening force features; i.e., making it more difficult for the fastener assembly to be opened by product shifting against the fastener than for the user to open the assembly from outside the bag. U.S. Pat. No. 4,829,641, Williams, discloses an interlocking closure device including two U-shaped closure elements with hooks on the ends of each of the U-shaped members for interlocking. Williams includes ribs in the center of both closures. However, the central ribs of Williams are used only to show color change when interlocked.

Although the above listed fastener profiles have achieved some degree of success, none have completely solved the problem of aligning the closure elements during sealing, or of providing a differential opening force such that it is more difficult to open the bag from within the bag than outside, while at the same time providing a means of cushioning the closure elements as they are sealed, thereby providing acceptable seals within a wider range of temperature and pressure settings and at the same time minimizing the precision required for aligning the closure elements.

OBJECTS OF THE INVENTION

Accordingly, it is an object of the invention to provide a fastener assembly which minimizes the precision required for aligning the closure elements.

It is additional object of the invention to provide a fastener assembly which cushions the closure elements as they are sealed, thereby providing acceptable seals within a wider range of temperature and pressure.

It is a further object of the present invention to provide a fastener assembly which minimize the precision of positioning of the sealing bars relative to the fastener profiles.

It is a further object of the invention to provide fastener assemblies which provide an improved differential opening force for reclosable containers.

It is an additional object of the present invention to provide such a fastener assembly which is low in cost, easy to manufacture, and easy for the consumer to use.

SUMMARY OF THE INVENTION

An improved fastener assembly is provided for reclosable plastic bags. The improved fastener assembly includes a substantially C-shaped closure element having a channel portion axially disposed therethrough. A first arm is located on the left side of the channel and a second arm is located on the right side of the channel. An alignment mechanism is axially disposed through the channel. A clasp or barb is attached to the distal end of the first arm and extends laterally inward from the first arm. A second clasp or barb is attached to the distal end of the arm and extends inwardly from the second arm.

A U-shaped closure element is also provided having a centrally located curved portion. First and second legs extend angularly off from the base of the U-shaped closure element so as to form a U configuration with the curved portion being disposed therebetween. A pair of flanges, or bumpers, extend laterally from the base of the U-shaped portion for selective impact against the first and second clasp members. Thus, the C-shaped and U-shaped closure elements are constructed and arranged to reclosably fasten to each other.

The first clasp includes a first curved clasp projection having a point at its tip. The curved clasp projection is directly inwardly toward the interior channel of the C-shaped member. The second clasp similarly includes a second curved clasp projection having a point at its tip directed inwardly towards the channel portion. The second clasp point may be rounded so as to facilitate disengagement of the closure elements.

The first hook member includes a first curved hook projection having a point at its tip which is directly outwardly away from the curved portion of the C-shaped closure. Similarly, the second hook includes a second hook curved projection having a point at its tip directed outwardly away from the curved portion of the C-shaped closure. The second hook point may also be rounded so as to facilitate disengagement of the closure elements as desired.

The first hook member and first leg may include a curved exterior portion and the second hook member and second leg may also include a curved exterior portion whereby the first clasp projection and second clasp projection cooperatively interact with the first hook member and second hook member so as to seat the first curved clasp projection within the curved exterior portion of the first hook member during closure and seat the second curved clasp projection within the curved exterior portion of the second hook member during closure.

The first clasp member may also include a curved interior portion and the second clasp member may also include a curved interior portion. The first hook projection and the second hook projection cooperatively interact with the first clasp and second clasp so as to seat the first hook projection within the interior curvature of the first clasp during interlocking and seat the second hook projection within the interior curvature of the second clasp during interlocking.

In a preferred embodiment, the U-shaped closure element includes a first base member with a pair of bumper elements extending laterally therefrom. The first bumper element is adjacent to the first leg portion and the second bumper element is adjacent to the second leg portion. The first and second bumper elements provide alignment of the U-shaped closure element during interlocking of the first and second closure elements.

Similarly, the C-shaped closure element has a second base member with the first arm and second arm disposed on the respective ends thereof and extending substantially perpendicularly therefrom.

Another means of aligning the first and second closure elements is at least one rib axially disposed on the interior surface of the channel portion of the C-shaped member. The rib member or members abut against the curved portion of the U-shaped closure element so as to align the U-shaped closure element with the C-shaped closure element during interlocking. Preferably, the one or more rib members are constructed and arranged to abut against the first and second leg members of the U-shaped closure element after interlocking of the closure elements, so as to prevent inadvertent opening of the fastener assembly.

In one embodiment, the first clasp member is larger than the second clasp member. As a result, the force required to open one side of the fastener assembly is greater than the force required to open the second opposite side of the fastener assembly. This is called "differential opening force" and is used to allow not only easy opening of the reclosable plastic container by the consumer, but also to prevent product from within the container from forcing the container open.

Similarly, the first hook member may be larger than the second hook member so as to provide differential opening force to the first side of the fastener assembly relative to the opening force required on the second opposite side of the fastener assembly. Preferably, the fastener assembly is constructed of flexible plastic material so as to facilitate easy opening. The material may be selected from commonly known plastic materials.

In a preferred embodiment, the first arm of the C-shaped closure element is greater in thickness than the second arm so as to require greater force to disengage the first clasp from the first hook than the second clasp from the second hook. Similarly, the first one of the ribs on the channel within the C-shaped closure element adjacent to the first arm may be larger in size than the second one of the ribs disposed adjacent the second arm, thereby affecting greater differential opening force on the first hook than the second hook.

The preferred purpose of the fastener assembly is for sealing to webs of plastic film, which are subsequently converted into reclosable plastic bags. This sealing is preferably performed simultaneously on both closure elements while they are interlocked. The ribs on the interior surface of the channel of the C-shaped closure element maintain alignment of the closure elements during sealing, and also align the closure elements during interlocking by guiding the first hook and second hook within the interior curvature of the first clasp, first arm and second clasp, and second arm respectively.

The first clasp member and first arm include a curved interior portion and the second clasp member and second arm include a curved interior portion. As mentioned above, the C-shaped closure includes a pair of ribs on its interior surface. Between the first one of the ribs and the interior surface of the first arm is a first groove. Similarly, between the second one of the ribs and the interior surface of the second arm is a second groove. The first rib guides the first hook into the first groove. Similarly, the second rib guides the second hook into the second groove. Thus, the first leg and second leg help align the U-shaped closure element with the C-shaped closure element.

In an alternative embodiment, a single rib may be centrally disposed in a channel portion of the C-shaped closure element for insertion into and abutment against the curved portion of the U-shaped closure element, thereby aligning the two closure elements.

In a preferred embodiment, the C-shaped and U-shaped closure elements include curved rear exterior surfaces on them. The curved rear exterior surfaces are constructed and arranged for elastic deformation under pressure, so as to facilitate alignment of the C-shaped closure element during sealing.

DETAILED DESCRIPTION OF THE PREFERRED EMBODIMENT

Figure 1:
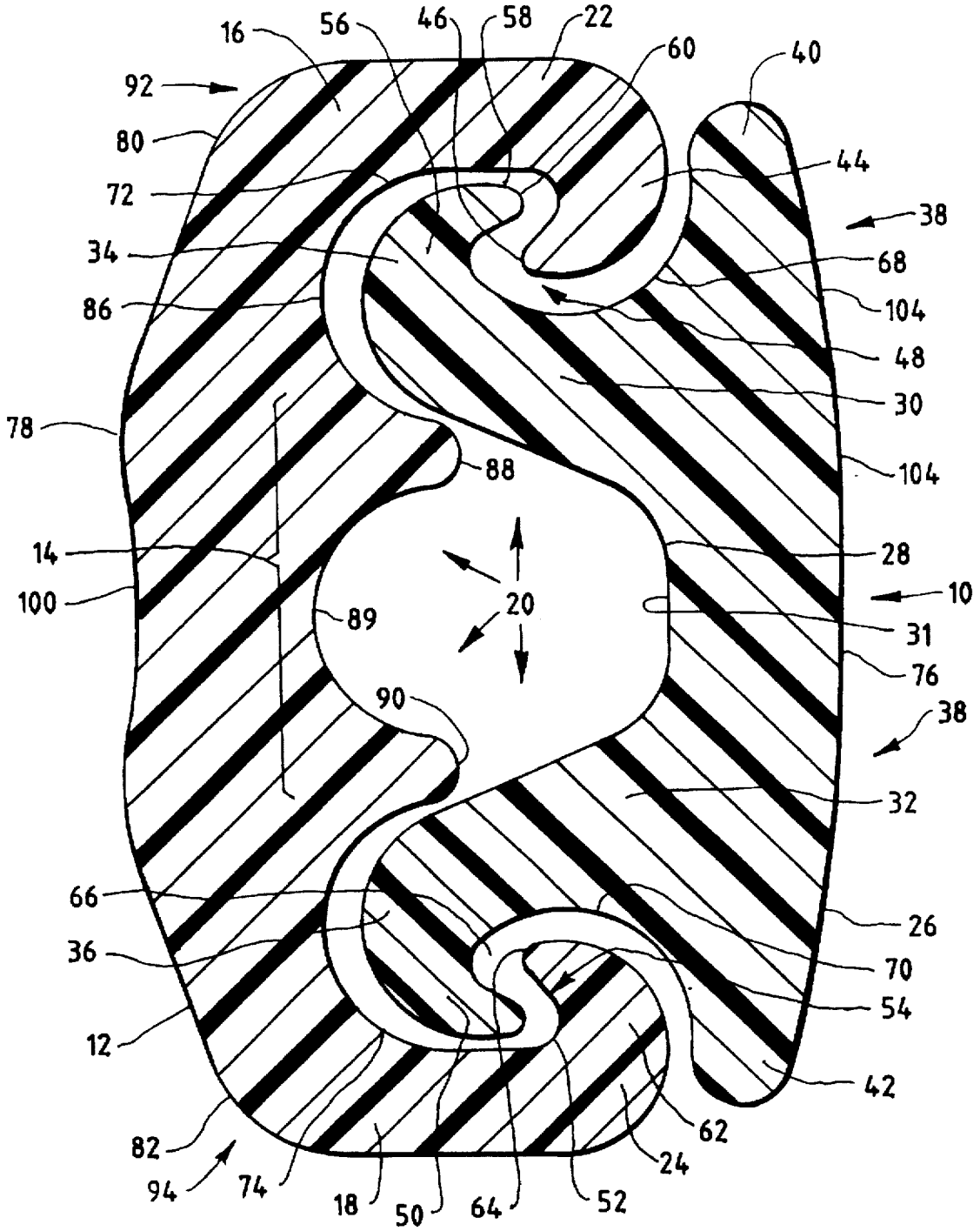
FIG. 1 is a vertical section of the improved fastener assembly of the present invention.

While the present invention is susceptible of embodiment in many different forms, there is shown in the drawings and will herein be described in detail several specific embodiments with the understanding that the invention is not limited thereto except insofar as those who have the disclosure before them are able to make modifications and variations therein without departing from the scope from the invention.

As shown in FIG. 1 of the drawings, a reclosable fastener assembly 10 is disclosed which includes a substantially C-shaped closure element 12. The C-shaped closure element 12 defines a channel portion 14, a first arm portion 16, and a second arm portion 18. A first alignment mechanism 20 is further disclosed which is axially disposed on the channel portion 14. A first clasp 22 is attached to and extends inwardly from the first arm portion 16. A second clasp 24 is attached to and extends inwardly from the second arm portion 18.

A substantially U-shaped closure element 26 is further provided. U-shaped closure element 26 defines a curved portion 28, a first extended leg portion 30, and a second extended leg portion 32. A first hook member 34 is attached to and extends laterally from the first extended leg portion 30. A second hook member 36 is attached to and extends laterally from the second extended leg portion 32. A second alignment mechanism 38 is provided which includes a pair of bumper elements 40 and 42 each extending laterally from U-shaped closure element 26 for selective impact against the first clasp 22 and the second clasp 24. The closure elements 12 and 26 are constructed and arranged to reclosably fasten to each other over a predetermined length of fastener strip.

In fastener assembly 10, the first clasp 22 includes a first curved clasp projection 44 having a first clasp point 46 at its distal end 48. The first clasp point 46 is directed inwardly toward the channel portion 14. The second clasp 24 includes a second curved clasp projection 50 having a second clasp point 52 at its distal end 54 directed inwardly toward the channel portion 14. In the embodiment shown, the second clasp point 52 is rounded so as to facilitate disengagement of the closure elements 12 and 26.

The first hook member 34 includes a first curved hook projection 56 having a first hook point 58 at its distal end 60 directed outwardly away from the curved portion 28. The second hook 36 includes a second hook curved projection 62 having a second hook point 64 located at its distal end 66 directed outwardly away from the curved portion 28. In the embodiment shown, the second hook point 64 is rounded to facilitate disengagement of the closure elements 12 and 26 as required.

In the fastener assembly 10, the first hook member 34 and first leg 30 include a curved exterior portion 68. Similarly, the second hook member 36 and the second leg 32 also include a curved exterior portion 70. The first clasp projection 44 and the second clasp projection 50 cooperatively interact with the first hook member 34 and the second hook member 36 so as to seat the first curved clasp projection 44 within the curved exterior portion 68 of the first hook member 34 and first leg member 30 during closure, and also seat the second curved clasped projection 50 within the curved exterior portion 70 of the second hook member 36 and second leg 32 during closure.

The first clasp member 22 and the first arm 16 include a curved interior portion 72. The second clasp member 24 and the second arm 18 also include a curved interior portion 74. The first hook projection 56 and the second hook projection 62 cooperatively interact with the first clasp 22 and the second clasp 24 so as to seat the first hook projection 56 within the interior curvature 70 of the first clasp 22 and first leg 30 during interlocking and also seat the second hook projection 62 within the curved interior portion 74 of the second clasp 24 and second leg 32 during interlocking.

In the fastener assembly of FIG. 1, the U-shaped closure element 26 includes a first base member 76 with bumper elements 40 and 42 extending laterally from the base member 76. The first bumper element 40 is attached to and extends laterally from the first base member 76 adjacent the first extended leg portion 30. The second bumper element 42 is attached to and extends laterally from the first base member 76 adjacent the second extended leg member 32. The first bumper element 40 and the second bumper element 42 provide alignment of U-shaped closure element 26 during interlocking of the closure elements 12 and 26. Similarly, the C-shaped closure element 12 includes a second base member 78 with the first arm 16 and second arm 18 disposed on their respective ends 80 and 82 of the second base member 78, arms 16 and 18 each extends substantially perpendicularly from second base member 78.

Figure 2:
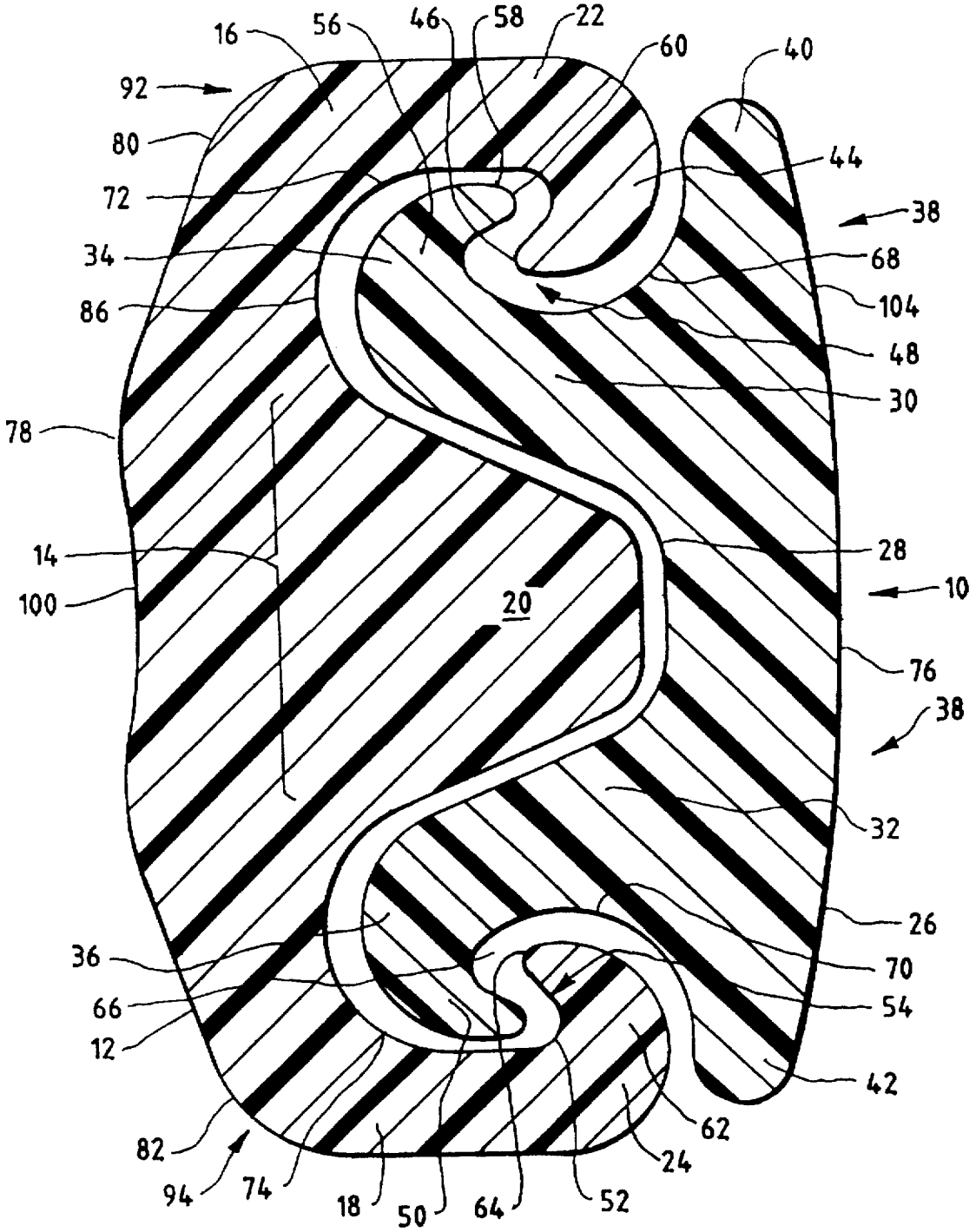
FIG. 2 is a vertical section of an alternative embodiment of the fastener assembly of the present invention showing in particular a single raised rib axially disposed on the interior surface of the C-shaped closure element.

The previously mentioned first alignment mechanism 20 includes in the preferred embodiment at least one rib member 84, best seen in FIG. 2, axially disposed on the interior surface 86 of the channel portion 14 of the C-shaped closure element 12. Rib member 86 is constructed and arranged for abutment against the curved portion 28 of U-shaped closure element 26 so as to align U-shaped closure element 26 with C-shaped closure element 12 during interlocking.

Returning to FIG. 1, in the embodiment shown, a pair of ribs including first rib 88 and second rib 90 are disclosed which are attached to the interior surface 86 of a channel 14 and are constructed and arranged for abutment against the curved portion 28 of U-shaped closure element 26, so as to align the U-shaped closure element 26 with the C-shaped closure element 12 during interlocking. First rib 88 and second rib 90 are further constructed and arranged to abut against first leg 30 and second leg 32 after interlocking of the closure elements 12 and 26 so as to prevent inadvertent opening of the fastener assembly 10.

Figure 3:
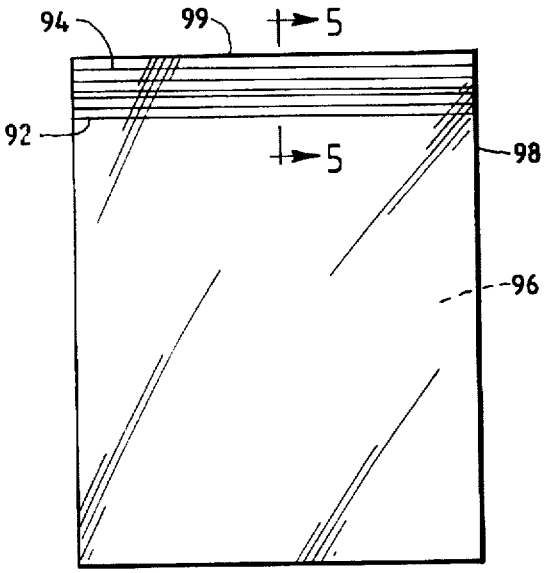
FIG. 3 is a front elevational view of a reclosable plastic bag utilizing the fastener assembly of the present invention.

As shown in FIG. 1, the first clasp member 22 is slightly larger in size than second clasp member 24 so as to provide a stiffer seal, thereby providing a greater differential opening force to a first side 92 of fastener assembly 10 relative to the second opposite side 94. As a result, in the manufacture of the reclosable container 98 of FIG. 3, reclosable fastener assembly 10 would be disposed so that the first side 92 of fastener assembly 10 would be facing the interior 96 of bag 98, thereby making it more difficult for product to force its way out of the bag 98. Conversely, the second side 94 of fastener assembly 10 would be facing outwardly towards the consumer or opening side 99 of the bag 98, thereby making it easier to open the bag 98. Similarly, returning to FIG. 1, the first hook member 34 is slightly larger in size than the second hook member 36 so as to provide a greater opening force on the first side 92 of the fastener assembly 10 relative to the second opposite side 94. Likewise, the first hook point 58 may be longer and sharper than the second hook point 64 of second leg 32 so as to more tightly grip the first clasp point 46. In addition, first clasp point 46 may also be sharpened and extended as desired to increase resistance to opening. In a preferred embodiment, fastener assembly 10 is constructed of flexible plastic materials such as acrylic, elastomeric alloy, polyamide, polyester, polyolefin, polyphenylene, polypropylene, polystyrene, polyurethane, silicone, thermoplastic, elastomer, vinyl based resin, elastomeric copolymer, elastomeric thermoset, elastomeric compound or composites, including elastomeric polymer. However, in a preferred embodiment, fastener assembly 10 is constructed of Petrethene R Na 420-127 low density polyethylene resin. Petrethene R Na 420-127 has medium slip and medium anti-block properties incorporated therein. The physical properties of Petrethene R Na 420-127 may be seen in the advertising literature attached to the parent application of the present invention and are incorporated herein by reference.

Figure 5:
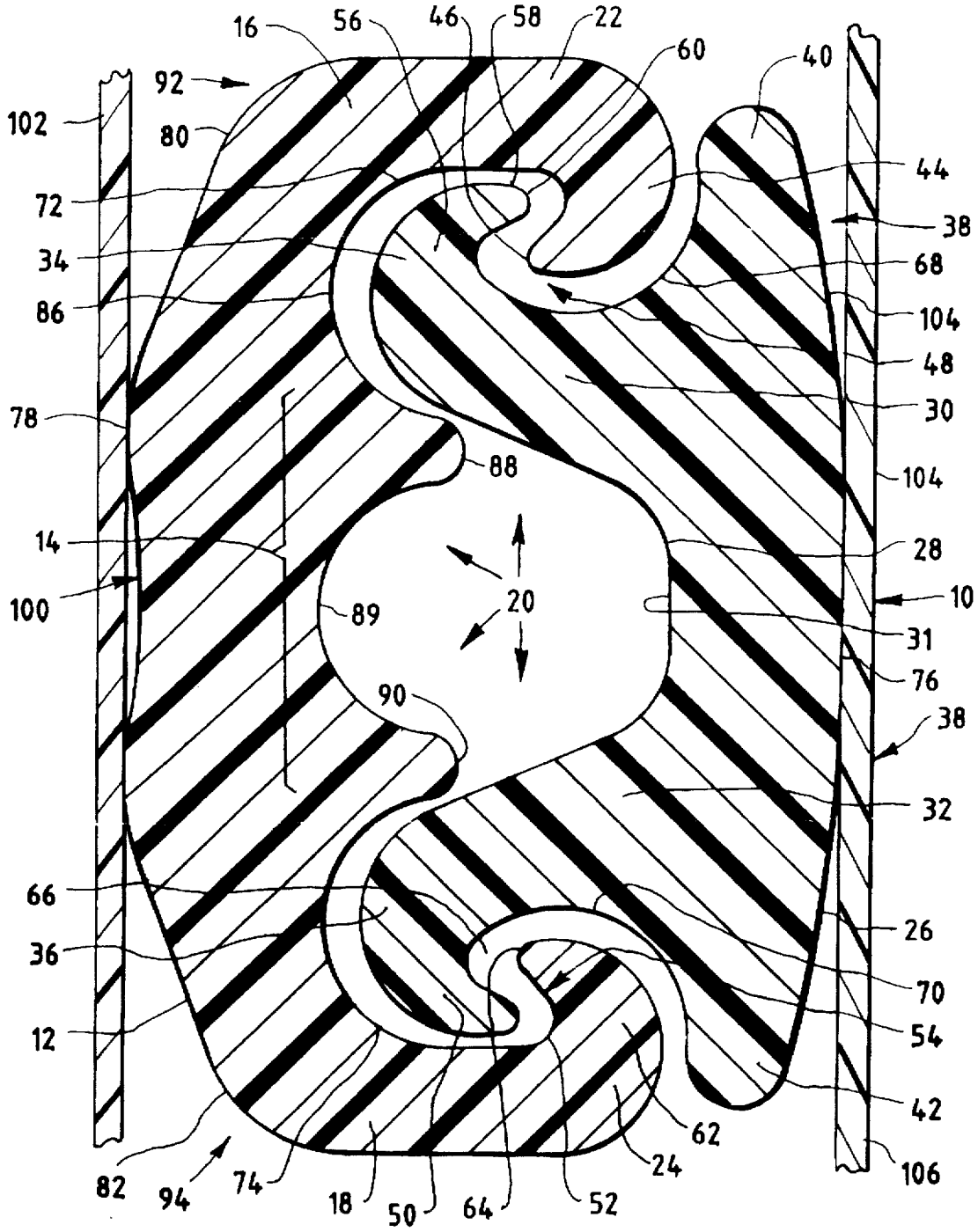
FIG. 5 is a vertical section of the fastener assembly of FIG. 1 sealed to first and second webs of plastic film.

In a preferred embodiment, C-shaped closure member 12 is sealed on its rear surface 100 to a web of plastic film 102, as shown in FIG. 5. Similarly, U-shaped closure element 26 is sealed on its rear surface 104 to either a second web of film 106 or, when first web 102 is folded to the same side 108 of web 102, but running along the opposite edge 110 of the web 102.

Figure 4:
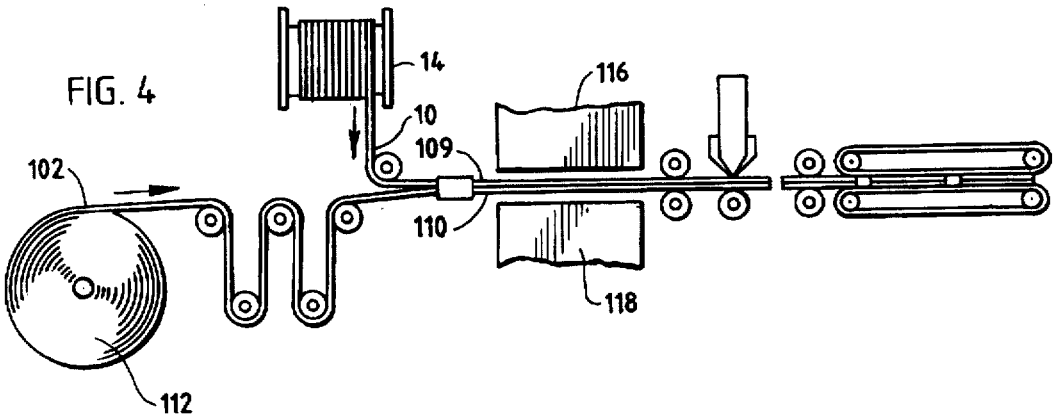
FIG. 4 is a side elevational view of a method of manufacturing reclosable bags using the fastener assembly of the present invention.

As shown in FIG. 4, web 102 is dispensed from a roller 112. Fastener assembly 10 including interlocked C-shaped closure elements 12 and 26 are similarly dispensed from a roller 114 in between the first edge 109 and second edge 110 of web 102. The closure elements 12 and 26 are then sealed to web 102 by means of sealing bars 116 and 118. One of the principal advantages of the present invention is that the previously mentioned first alignment means mechanism 20 and second alignment mechanism 28 align the C-shaped closure element 12 and the U-shaped closure element 26 during sealing. Thus, the size of the seal on the rear surface 100 of C-shaped closure element 12 and the rear surface 104 on U-shaped closure element 26 may be made significantly smaller, by as much as 0.025" in width, while still allowing effective interlocking of the closure elements 12 and 26 (See FIG. 1). This ability is not shown in prior art closures. Similarly, the exact amount of force required is broader in range than those previously known. However, the seal should be placed directly over ribs 88 and 90 whenever possible.

A further advantage of the present invention is that ribs 88 and 90 and legs 30 and 32 are thicker than the gap 31 between legs 30 and 32 and the gap 89 between ribs 88 and 90. Thus, when rear surface 100 is sealed to web 102 over gap 89 of C-shaped closure element 12, a lower sealing temperature may be used than is ordinarily used with conventional fastener assemblies. As a result, it is easier to seal, and a smaller seal may be effected, preferably on the opposite side of closure 12 between ribs 88 and 90; (gap 89). Similarly, legs 30 and 32 tend to resist heat, allowing lower sealing temperatures of rear surface 104 of U-shaped closure element 26 to web 106 over gap 31.

Alignment of the closure elements 12 and 26 is facilitated by a combination of ribs 88 and 90 interacting with curved portion 28. As pressure is applied to the rear surfaces 100 and 104, ribs 88 and 90 are pressed inwardly into the curved portion 28. U-shaped closure element 26 is thereby stabilized and maintained in the correct lateral position relative to C-shaped closure member 12. In addition, the curved rear surfaces 100 and 104 allow some deformation of the closure element without misaligning of them. This is also facilitated by the use of resilient elastic material as disclosed in this and in the parent application of the present invention.

Even in those instances where the C-shaped closure element 12 is sealed separately to a web 102 and the U-shaped closure element 26 is sealed to a second web 26, the configuration of the opened channel portion 14 allows for correction of misalignment and for guidance of the first hook 34 and the second hook 36 into the channel 14 more easily than prior art closures having an arrow shaped barb and C-shaped channel with projections inward.

In a preferred embodiment, closure elements 12 and 26 are 0.121" wide ±0.020" and are 0.072"±0.020" high when interlocked. In a preferred embodiment, the U-shaped closure element 12 includes the first base member 76 with the first leg 30 and second leg 32 extending angularly therefrom with a curved portion 28 being disposed therebetween. In a preferred embodiment, first leg portion 30 and second leg portion 32 extend angularly at an angle of greater than 30° from each other. Similarly, C-shaped closure element 12 includes a second base member 78 with the first arm 16 and second arm 18 at the respective ends 80 and 82 of second base member 78 and extending substantially perpendicularly therefrom. In a preferred embodiment, as shown in FIG. 1, C-shaped closure element 12 further includes a pair of coaxially disposed grooves formed in the channel portion 14 which are sized, constructed, and arranged for reception respectively of the first hook member 34 and the second hook member 36 during interlocking.

In the embodiment shown, the ribs 88 and 90, or in the case of FIG. 2, the rib 84 acts as a shock absorber between the closure elements 12 and 26 during interlocking. The base members 76 and 78 each have a thickness of 0.020"±0.005" and a modulus of elasticity of 22,000 psi (pounds per square inch) ±4,000 psi with ASTM test D882.

I claim:

1. A reclosable fastener assembly comprising:

a substantially C-shaped closure element; said C-shaped closure element defining a channel portion, a first arm portion, and a second arm portion; first alignment means axially disposed on said channel portion; a first clasp attached to and extending inwardly from said first arm portion; a second clasp attached to and extending inwardly from said second arm portion;

a substantially U-shaped closure element; said U-shaped closure element defining a curved portion, a first extended leg portion, and a second extended leg portion; a first hook member attached to and extending laterally from said first extended leg portion; a second hook member attached to and extending laterally from said second extended leg portion; second alignment means comprising a pair of bumper elements each extending laterally from said U-shaped closure element for selective impact against said first and second clasp members; and said closure elements being constructed and arranged to reclosably fasten to each other over a predetermined length.

2. The fastener assembly of claim 1 wherein said first clasp comprises a first curved clasp projection having a first clasp point at its distal end directed inwardly towards said channel portion, and said second clasp comprises a second curved clasp projection having a second clasp point at its distal end directed inwardly towards said channel portion.

3. The fastener assembly of claim 2 wherein said first hook member and said first leg include a curved exterior portion and said second hook member and second leg include a curved exterior portion, and said second hook member and second leg include a curved exterior portion, and wherein said first clasp projection and said second clasp projection cooperatively interact with said first hook member and said second hook member so as to seat said first curved clasp projection within said exterior curved portion of said first hook member and first leg during closure and seat said second curved clasp projection within said exterior curved portion of said second hook member and second leg during closure.

4. The fastener assembly of claim 3 wherein said C-shaped closure element comprises a curved rear exterior surface opposedly disposed from said channel portion, said curved rear exterior surface being constructed and arranged for elastic deformation under pressure so as to facilitate alignment of said C-shaped closure element during sealing.

5. The fastener assembly of claim 3 wherein said closure elements are 0.121" wide ±0.020 and are 0.072"±0.020 high when interlocked.

6. The fastener assembly of claim 3 wherein said U-shaped closure elements comprises a first base member with said first leg and second legs extending angularly therefrom with said curved portion being disposed therebetween.

7. The fastener assembly of claim 3 wherein said C-shaped closure element comprises a second base member with said first arm and said second arm disposed on the respective ends of said second base member and extending substantially perpendicularly therefrom.

8. The fastener assembly of claim 3 wherein said ribs act as shock absorbers between said closure elements during interlocking.

9. The fastener assembly of claim 3 wherein said closure elements each have a base member and means for interlocking with an opposed closure element, said base member being elastically deformable and resilient so as to facilitate sealing of said base member to reclosable plastic containers.

10. The fastener assembly of claim 9, wherein said base members each have a thickness of 0.020±0.005; and a modulus of elasticity of 22,000 psi ±4,000 psi.

11. The fastener assembly of claim 3 wherein said first leg and said second leg extend angularly from said base member at an angle of >30° from each other.

12. The fastener assembly of claim 2 wherein said second clasp point is rounded so as to facilitate disengagement of said closure elements.

13. The fastener assembly of claim 1 wherein said first hook member comprises a first curved hook projection having a first point at its distal end directed outwardly away from said curved portion, and said second hook comprises a second hook curved projection having a second hook point at its distal end directed outwardly away from said curved portion.

14. The fastener assembly according to claim 13 wherein said second hook point is rounded to facilitate disengagement of said closure elements.

15. The fastener assembly of claim 13 wherein said first clasp member and first arm include a curved interior portion and said second clasp member and second arm include a curved interior portion and wherein said first hook projection and said second hook projection cooperatively interact with said first clasp and said second clasp so as to seat said first hook projection within said curved interior portion of said first clasp during interlocking and seat said second hook projection within said curved interior portion of said second clasp and second leg during interlocking.

16. The fastener assembly of claim 15 wherein said C-shaped closure element further comprises a pair of co-axially disposed grooves formed in said channel, said grooves being constructed and arranged for reception respectively of said first hook members and said second hook members.

17. The fastener assembly of claim 1 wherein said U-shaped closure element comprises a first base member with said pair of bumper elements comprising first bumper element attached to and extending laterally from said first base member adjacent said first extended leg portion and a second bumper element attached to and extending laterally from said first base member adjacent said second extended leg portion, said first bumper element and said second bumper element providing alignment of said U-shaped closure element during interlocking of said closure elements.

18. The fastener assembly of claim 1 wherein said C-shaped closure element comprises a first base member with said first arm and said second arm disposed on the respective ends of said second base member and extending substantially perpendicularly therefrom.

19. The invention of claim 1 wherein said first alignment means comprises at least one rib member axially disposed on said interior surface of said channel portion of said C-shaped closure element, said rib member being constructed and arranged for abutment against said curved portion of said U-shaped closure element, so as to align said U-shaped closure element with said C-shaped closure element during interlocking.

20. The invention of claim 19 wherein said one or more rib members are constructed and arranged to abut against said first and second leg members after interlocking of said closure elements, so as to prevent inadvertent opening of said fastener assembly.

21. The fastener assembly of claim 19 wherein said closure elements each have a product side and a consumer side, said closure elements being constructed and arranged for disengaging more easily on said consumer side than said product side, so as to selectively retain product in said reclosable plastic container.

22. The invention of claim 1 wherein said first clasp member is larger than said second clasp member so as to provide differential opening force to a first side of said fastener assembly relative to a second side opposite of said fastener assembly.

23. The invention of claim 1 wherein said first hook member is larger than said second hook member so as to provide differential opening force to a first side of said fastener assembly relative to a second opposite side of said fastener assembly.

24. The fastener assembly of claim 1 wherein said C-shaped closure member is sealed on its rear surface to a web of plastic film and said U-shaped closure element is sealed on its rear surface to a second web of plastic film, said webs of film and closure elements being constructed and arranged for joining together so as to form a double web of plastic film suitable for conversion into reclosable plastic bags.

25. The fastener assembly of claim 24 wherein said C-shaped closure element and said U-shaped closure element are sealed simultaneously to said respective first and second webs of plastic film after interlocking, and said pair of ribs are sized and positioned to maintain alignment of said closure elements during sealing.

26. The fastener assembly of claim 24 wherein said C-shaped closure element and said U-shaped closure element are each respectively sealed to said first plastic web of film and said second plastic web of film, and subsequently interlocked, said ribs being sized and positioned to align said closure elements during interlocking of said closure elements during said sealing.

27. The fastener assembly of claim 1 wherein said first alignment means comprises a rib attached to said channel portion, said rib being shaped and positioned for insertion into and abutment against said curved portion of said U-shaped closure element.

28. A reclosable fastener assembly comprising:

a substantially C-shaped closure element, said C-shaped closure element defining a channel portion having an interior surface, a first arm portion, and a second arm portion; a pair of ribs attached to the interior surface of said channel portion; a first clasp attached to and extending from said first arm portion, said first clasp having a curvature directed inwardly towards the interior portion of said channel portion; a second clasp attached to said second arm portion, said second clasp having a curvature directed inwardly towards the interior portion of said channel portion;

a substantially U-shaped closure element; said U-shaped profile defining a curved portion, a first extended leg portion, and a second extended leg portion; a first hook member attached to and extending from said first extended leg portion, said first hook member having a curvature directed outwardly away from said curved portion; a second hook member attached to and extending from said second extended portion, said second hook member having a curvature directed outwardly away from said curved portion; and said pair of ribs being constructed and arranged to align said first leg and said second leg and said curved portion during interlocking of said C-shaped closure element and said U-shaped closure element.

29. The fastener assembly of claim 28 wherein after interlocking, said fastener assembly is constructed and arranged to require greater force to disengage said first clasp from said first hook than the force required to disengage said second leg from said second hook.

30. The fastener assembly of claim 29 wherein said first arm is greater in thickness than said second arm, so as to require greater force to disengage said first clasp from said first hook than said second clasp from said second hook.

31. The fastener assembly of claim 28 wherein a first one of said ribs disposed adjacent to said first arm is larger in size than a second one of said ribs disposed adjacent said second arm, thereby effecting greater differential opening force on said first hook than said second hook.

32. A reclosable fastener assembly comprising:

a substantially C-shaped closure element, said C-shaped closure element defining a channel portion having an interior surface, a first arm portion, and a second arm portion; at least one rib attached to the interior surface of said channel portion; a first clasp attached to and extending from said first arm portion, said first clasp having a curvature directed inwardly towards the interior portion of said channel portion; a second clasp attached to said second arm portion, said second clasp having a curvature directed inwardly towards the interior portion of said channel portion;

a substantially U-shaped closure element; said U-shaped profile defining a curved portion centrally located thereon, a first extended leg portion, and a second extended leg portion; a first hook member attached to and extending from said first extended leg portion, said first hook member having a curvature directed outwardly away from said curved portion; a second hook member attached to and extending from said second extended portion, said second hook member having a curvature directed outwardly away from said curved portion; and said one or more ribs being constructed and arranged to align said first leg and said second leg and said curved portion during interlocking of said C-shaped closure element and said U-shaped closure element.

33. A reclosable fastener assembly comprising:

a substantially C-shaped closure element, said C-shaped closure element defining a channel portion having an interior surface, a first arm portion, and a second arm portion; a first clasp attached to and extending from said first arm portion, said first clasp having a curvature directed inwardly towards the interior portion of said channel portion; a second clasp attached to said second arm portion, said second clasp having a curvature directed inwardly towards the interior portion of said channel portion;

a substantially U-shaped closure element; said U-shaped profile defining a curved portion centrally located thereon, a first extended leg portion, and a second extended leg portion; a first hook member attached to and extending from said first extended leg portion, said first hook member having a curvature directed outwardly away from said curved portion; a second hook member attached to and extending from said second extended portion, said second hook member having a curvature directed outwardly away from said curved portion; and said closure elements being constructed and arranged to align said first leg and said second leg and said curved portion during interlocking of said C-shaped closure element and said U-shaped closure element.

* * * * *